US012788171B2

(12) United States Patent
Quanquin et al.

(10) Patent No.: US 12,788,171 B2
(45) Date of Patent: Nov. 10, 2026

(54) PARCEL DETECTION DEVICE

(71) Applicant: QUADIENT TECHNOLOGIES FRANCE, Bagneux (FR)

(72) Inventors: Gael Quanquin, Cachan (FR); Christophe Peynet, L'Hay les Roses (FR); Nicolas Froissart, Villepinte (FR)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 356 days.

(21) Appl. No.: 18/660,502

(22) Filed: May 10, 2024

(65) Prior Publication Data

US 2024/0374064 A1 Nov. 14, 2024

(30) Foreign Application Priority Data

May 12, 2023 (EP) ..... 23305749

(51) Int. Cl.
*A47G 29/122* (2006.01)

(52) U.S. Cl.
CPC .. *A47G 29/1225* (2013.01); *A47G 2029/1226* (2013.01)

(58) Field of Classification Search
CPC ..... A47G 29/1225; A47G 2029/1226; G01S 17/003; G01S 17/04; G01S 17/88; G01V 8/14; G02B 5/10; G02B 19/0023; G02B 19/0085; G07F 9/026; G07F 11/62; G07F 17/13
See application file for complete search history.

(56) References Cited

U.S. PATENT DOCUMENTS 4,742,337 A * 5/1988 Haag ..... G08B 21/02 250/221
5,583,334 A * 12/1996 Baumann ..... G08B 13/183 250/221
6,441,361 B1 8/2002 Bennett et al.
7,693,745 B1 * 4/2010 Pomerantz ..... G07F 17/13 705/26.5

FOREIGN PATENT DOCUMENTS

EP 2891433 A1 7/2015
JP 2009064763 A 3/2009

* cited by examiner

*Primary Examiner* — Isam A Alsomiri
(74) *Attorney, Agent, or Firm* — Cozen O'Connor

(57) ABSTRACT

A parcel detection device for detecting an item in a compartment of a parcel locker, comprising a laser diode for emitting a light beam and a light reflector for reflecting said light beam towards a light sensor for detecting said light beam, said light reflector comprising two square rulers or rods carrying opposite mirrors, a first square ruler or rod carrying a plurality of concave mirrors disposed in front of a flat mirror carried by a second square ruler or rod.

16 Claims, 9 Drawing Sheets

PARCEL DETECTION DEVICE

FIELD OF THE INVENTION

The present application relates to a locker system comprising several lockable compartments for the delivery of parcels or similar items. More specifically it relates to a device for detecting parcels deposited by a delivery agent into one of the lockable compartments, stored for a period of time, and picked-up by customers at their convenience.

BACKGROUND

Electronic parcel locker systems are used for dropping-off, storing and picking up various kinds of shipments such as parcels or packages. Such systems are typically used by carrier agents for depositing shipments, and by recipients to pick them up at convenient time, avoiding the cost and delay of failed deliveries (e.g., when the recipient is not at home). Parcel lockers may be situated in residential buildings, office buildings, open streets, or public places such as train stations. Parcel lockers may be found in shopping malls and used for the delivery or temporary storage of goods purchased in local retail stores or online. Residential parcel lockers can also be used for the delivery of all kinds of items by carriers and local merchants.

Electronic parcel lockers comprise a control unit and a user interface, typically a touchscreen, allowing the users to enter information for operating the parcel locker and opening the lockable compartments to either deposit of pick-up shipments. The user interface may include a barcode reader to capture information attached to the shipment or to a user identification mean. This function can also be fulfilled by other technologies such as RFID or NFC. An electronic parcel locker system generally comprises a network of lockers communicating with a remote central server via a wide area network or wireless technologies such as GSM or UMTS. The central server can be also in charge of generating electronic messages for the recipients, such as SMS, emails, or in-app notifications, including unique code combinations allowing them to open the lockable compartment containing their shipments.

Conventionally, parcel lockers are equipped with presence sensors to ensure that an item has been properly deposited into, or removed from, the right compartment and not inadvertently forgotten or misplaced in a wrong one. The presence sensors are monitored during drop-off or pick-up operations, along with door open/close detectors. Warning or alert messages may be sent to the user and the central server in case of mishandling. The control system may also prevent a door from closing if an item has been left or introduced in a compartment where it is not supposed to be. Item presence detection can be linked to security requirements in public places like train stations or hospitals.

The design of the presence sensor must cope with the wide variety of items likely to be stored in a parcel locker. Parcels themselves can vary largely in shape, dimensions, weight, and appearance, not talking of other items like clothes or food. Small objects not thicker than one centimetre (and not larger than ten) shall be detectable whatever their position is inside the compartment, itself typically forty centimetres wide and sixty centimetres deep. Many factors must be optimized to ensure reliable operation in a large temperature range and over several years. Ultimately, as a parcel locker may comprise dozens of compartments having each a presence sensor, the cost of the device shall be optimized as well.

A weight sensor may be used to detect the presence of an item deposited in a parcel locker. This is the case for instance in EP2891433 which describes an improved secure locker method and system, ensuring that the shipment deposited inside the locker is the right one. The system includes at least one electronic locker unit connected to a managing distribution centre through a communication network and having several lockable compartments of different sizes. An identification code of the shipment is entered at the electronic locker unit and specific information associated with the shipment is retrieved. The method comprises opening a compartment of the electronic locker unit, depositing the shipment inside the compartment, weighing the shipment and comparing the measured weight with the weight included within the specific information. The electronic locker unit of EP2891433 comprises a weighing module made up of an arrangement of flexible force sensors located under an upper bearing plate and attached to the bottom of the compartment. The weighing module based on these specific sensors is compact, affordable, and reasonably accurate. However, it is quite sensitive to temperature variations and may not be precise enough to detect very light items.

Light sensors are commonly used for detecting items deposited in a lockable compartment. An array of light emitters is coupled with an array of receivers. Emitters are disposed on one side and at the bottom of the compartment, and receivers at the other side. The emitters are close enough, typically ten centimetres apart from each other, to ensure that at least one light beam will be obfuscated by the smallest item to be detected. Emitters and receivers must be wired on each side of the compartment. Sensor signals are then relayed to a PCB or to the control unit itself, resulting in significant cost and a complex cabling when the parcel locker comprises several dozens of compartments.

A solution to this problem would be to place emitters and receivers on the same side of the compartment, and a flat mirror on the other side. However, some parcels are bright enough to reflect the light from an emitter to a receiver, resulting in a false negative detection. This can of course be mitigated by calculating light travel time, but this requires a complex logic which increases the cost of the solution. Similarly, proximity sensors (without mirrors) may be used, but detecting a small item located at the other side of the compartment is not always possible, and their cost is much higher than simple light diodes anyway.

Other solutions are described in U.S. Pat. No. 6,441,361 or JP2009064763. Instead of arrays of light emitters and sensors, a unique laser diode is mounted in one corner of a frame and flat mirrors are disposed opposite to each other on both sides. The laser beam is reflected several times by the mirrors towards a light receiver mounted in a corner adjacent to the laser diode. In this manner, the cabling is greatly simplified. Such solutions are more costly than the light arrays because the frame must be rigid enough, and the mirrors tightly adjusted, for the light beam to hit the receiver. Indeed, with flat mirrors facing each other, a small deviation of the light beam may cause it to miss the target by large, as the initial deviation is amplified after each reflection.

In parcel lockers with compartments typically 40 centimetres wide and 60 centimetres deep, a deviation of 1° in the horizontal plane will result in an error of around 6 centimetres after the light has travelled for approximately 3.50 metres. Additionally, if the mirrors are not parallel in the vertical plane, the light beam may escape one or the other after a few reflections and never reach the light receiver. Even if the mirrors are perfectly parallel, a small angular deviation of the light beam in the vertical plane is likely to have the same result, or at least cause it to miss the target. A wrong positioning of the laser diode or of the light receiver along the compartment wall may also cause the light beam to miss the target. Fixing these issues would normally require adjustments of either the initial firing angle or the position of the laser diode, or both.

The frames of U.S. Pat. No. 6,441,361 or JP2009064763 are satisfactory for small detection areas and relatively small items but are not well suited for larger dimensions. Moreover, the frames may be distorted once installed in a locker compartment, or the locker itself may be subject to deformations if not disposed on a perfectly flat ground.

There is a need for a parcel detection device that can be easily mounted in a locker compartment, without requiring a complex cabling on both sides. The device shall also be cost effective, insensitive to manufacturing tolerances and not requiring tight adjustments.

SUMMARY

A parcel detection device can detect items as small as 10 cm×10 cm×1 cm deposited in a locker compartment.

A parcel detection device can be easily installed in a locker compartment without requiring tight adjustments or any adjustment at all.

A parcel detection device can be installed in a locker compartment with a simplified cabling located on one side thereof.

A parcel detection device with a small number of components, advantageously limits its manufacturing cost.

A parcel detection device can withstand a wide range of operating conditions, notably temperature, without losing its functionality.

A parcel detection device for detecting an item in a compartment of a parcel locker, comprises a laser diode for emitting a light beam and a light reflector for reflecting said light beam towards a light sensor for detecting said light beam, wherein said light reflector comprises two square rulers or rods carrying opposite mirrors, a first square ruler or rod carrying a plurality of concave mirrors disposed in front of a flat mirror carried by a second square ruler or rod.

Preferably, the plurality of concave mirrors comprises an even number of concave mirrors.

Advantageously, the optical axes of the concave mirrors are orthogonal to the first square ruler or rod and the concave mirrors have a radius of curvature substantially equal to the orthogonal distance between the two square rulers or rods.

Preferably, the square rulers or rods carrying opposite mirrors are fixed at the bottom and on opposite sides of the compartment.

According to an embodiment, the concave mirrors are cylindrical mirrors of vertical axis located at points distant from each other of a determined gap and disposed in front of the flat mirror, itself disposed in a vertical plane.

Advantageously, the cylindrical mirrors are formed by equally spaced cylindrical portions etched in a first square ruler made of, or subsequently coated with, a reflective material, and the flat mirror is formed in a second square ruler made of, or coated with, a reflective material.

According to another embodiment, the concave mirrors are spherical mirrors located at points distant from each other of a determined gap and disposed in front of the flat mirror, itself disposed in a vertical plane.

Preferably, the light beam is configured to be fired at an appropriate angle to hit the vertex of the first cylindrical mirror or the pole of the first spherical mirror.

Advantageously, the second square ruler carrying the flat mirror is thick enough to lodge the laser diode and the light sensor.

Preferably, the number of concave mirrors is adapted to the dimensions of the compartment and/or of a smallest item to be detected in the compartment.

Advantageously, the inner dimensions of the compartment are approximately 42 centimetres wide and 59 centimetres deep and the item can be as small as 10×10×1 centimetres.

According to another embodiment, the mirrors are formed in square rods by removing inner sections having a dihedral angle of 90°, the inner sections of the square rods having flat sides angled at +/−45° with respect to the vertical axis, and equally spaced cylindrical sections are etched in the upper side, or alternatively in the lower side, of the inner section of one of the two square rods to form the cylindrical mirrors and the two square rods are fixed at the bottom and on opposite sides of the compartment with their inner sections facing each other.

Advantageously, a recess is carved in the second square ruler or rod to lodge the laser diode along its longitudinal axis and a small flat mirror is added or carved at the end of the second square ruler or rod to reflect the light beam towards the first square ruler or rod.

Preferably, the parcel detection device further comprises a sensor attached to a side of the compartment or integrated in a lock of a door of the compartment to detect the position of the door.

Advantageously, the light beam is configured to be obfuscated when an item is placed in the compartment, and the item is detected.

BRIEF DESCRIPTION OF THE DRAWINGS

The invention will be described and explained with additional specificity and detail through the use of the accompanying drawings in which.

DETAILED DESCRIPTION OF EXEMPLARY EMBODIMENTS

Figure 1:
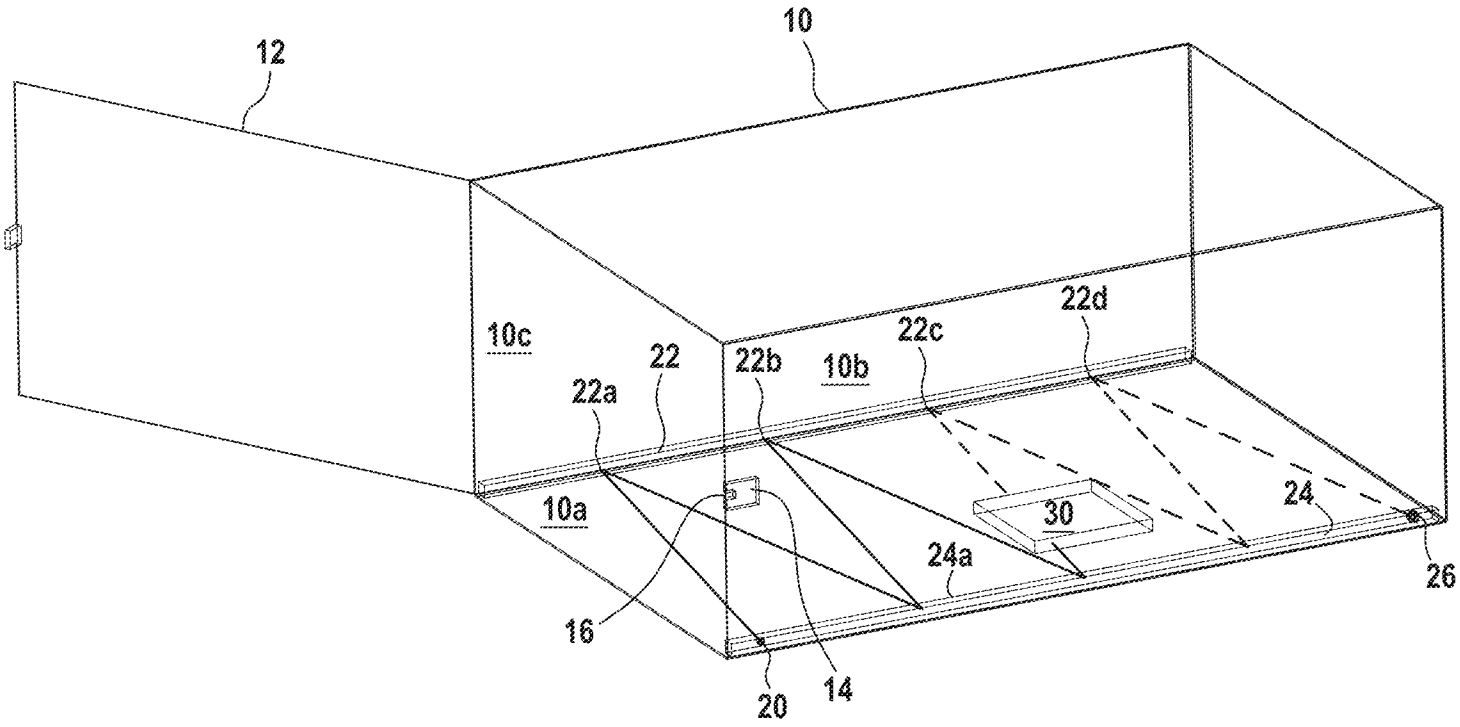
FIG. 1 is a schematic view of a locker compartment equipped with a parcel detection device according to the invention.

FIG. 1 is a schematic view of a locker compartment 10 having a door 12 with a lock 14 and equipped with a parcel detection device according to the invention.

The parcel detection device comprises a laser diode 20 mounted in one corner at the bottom 10*a* of the compartment, mirrors 22*a*, 2*b*, 22*c*, 22*d*; 24*a* disposed opposite to each other on both sides 10*b*, 10*c* of the compartment and a light sensor 26 mounted in the adjacent corner on the same side than the laser diode. The light beam emitted by the laser diode (or laser beam) is reflected several times before reaching the light sensor by the mirrors towards the light sensor. In a typical embodiment, the inner dimensions of the compartment are approximately 42 centimetres wide and 59 centimetres deep. When an item 30 is placed in the compartment 10, the light beam is obfuscated, and the item is detected. To detect items as small as 10×10×1 cm, the light of the laser beam shall browse a space no higher than one centimetre at the bottom 10*a* of the compartment. The bottom 10*a* is in a substantially horizontal plane and the sides 10*b*, 10C are in substantially vertical planes, parallel to each other.

In normal operation, the laser diode 20 can only be activated when the door 12 is closed. A position sensor 16 is attached to a side 10*b* of the compartment or integrated in the lock 14 to detect the position of the door. However, it may be necessary for a field technician to check that the parcel detection device is working properly, or to make some adjustments with the door open. The laser diode 20 is preferably mounted near the door 12, so as to fire towards the interior of the compartment.

Instead of flat mirrors facing each other like in U.S. Pat. No. 6,441,361 or JP2009064763, the parcel detection device of the invention comprises four concave mirrors 22*a*, 22*b*, 22*c*, 22*d* located on one side of the compartment, the other side receiving a flat mirror 24*a*. The concave mirrors 22*a*, 22*b*, 22*c*, 22*d* and the flat mirror 24*a* can be for instance carried by two square rulers 22, 24 fixed at the bottom 10*a* and on opposite sides 10*b*, 10*c* of the compartment 10. The optical axes of the concave mirrors are orthogonal to the square ruler 22 and substantially parallel to the bottom 10*a* of the compartment. The nominal angle of the light beam is chosen to make it reach the light sensor 26 after seven reflections. For instance, an angle of 81.5° is adapted to inner compartment dimensions of 422 by 587 mm. This arrangement is relatively insensitive to small deviations of the light beam, or small misplacements of the laser diode 20 and/or the light sensor 26 along the compartment wall, as will be explained thereafter.

Figure 2:
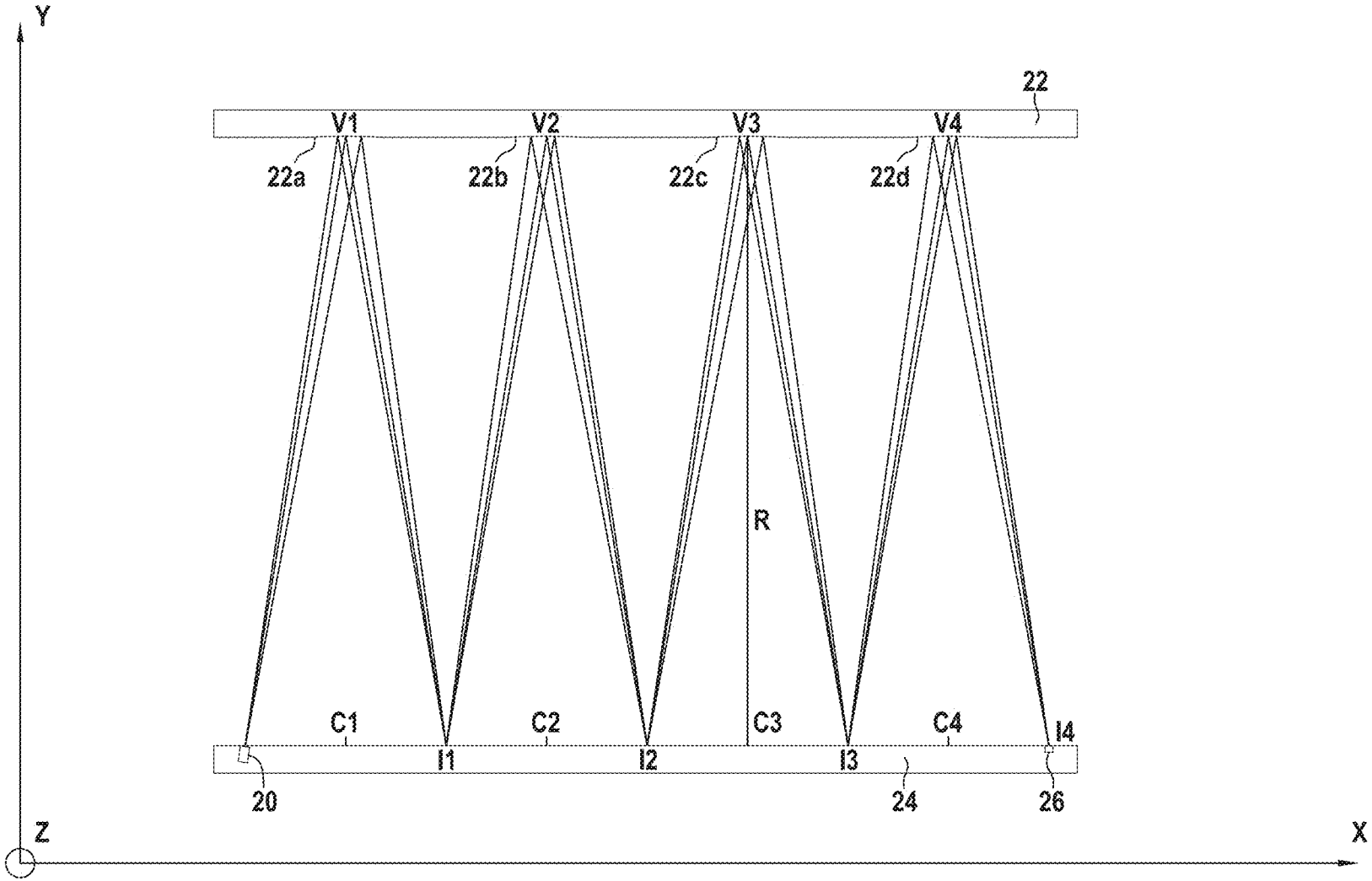
FIG. 2 is a schematic top view of a first embodiment of the parcel detection device of the invention.

FIG. 2 is a schematic top view of a first embodiment of the parcel detection device.

In the following, we assume that light travel takes place essentially in the horizontal plane and can be represented in a top view. A cartesian coordinate system XYZ is used, the X axis corresponding to the depth, and the Y axis to the width of the compartment 10.

In this first embodiment, the four concave mirrors 22*a*, 22*b*, 22*c*, 22*d* are cylindrical mirrors of vertical axis located at points distant from each other of a determined gap (typically 128 mm), where the laser beam will be reflected. In a preferred embodiment, these cylindrical mirrors are formed by equally spaced cylindrical portions etched in a first square ruler 22 made of, or subsequently coated with, a reflective material. These cylindrical mirrors are disposed in front of the flat mirror 24*a*, itself disposed in a vertical plane. The flat mirror is preferably a second square ruler 24 made of, or coated with, a reflective material. Only portions thereof, corresponding to the points $I_1$, $I_2$, $I_3$ where the light beam will be reflected, may be coated. Both rulers are fixed at the bottom and on opposite sides of the compartment 10.

The second flat ruler 24 carrying the flat mirror 24*a* is thick enough to lodge the laser diode 20 and the light sensor 26, which are mounted on opposite ends thereof. The light beam is fired at an appropriate angle to hit the vertex of the first cylindrical mirror 22*a*. The optical axis of a cylindrical mirror is the line joining its vertex (deepest point of the surface) and its centre (intersection of the vertical axis and the horizontal plane). The optical axes of the concave mirrors are orthogonal to the square ruler 22 and substantially parallel to the bottom 10*a* of the compartment. The radius R of the cylindrical mirrors is substantially equal to the orthogonal distance between the two rulers 22, 24, so slightly smaller than the width of the compartment. The vertexes $V_1$, $V_2$, $V_3$, $V_4$ are equally spaced and the centres $C_1$, $C_2$, $C_3$, $C_4$ are located near the surface of the flat mirror 24*a* on the other side of the compartment.

As can be seen from FIG. 2, the light beam emitted by the laser diode 20 is reflected by the first cylindrical mirror 22*a* symmetrically with respect to its optical axis to a first point $I_1$ situated on the flat mirror 24*a*. This point is the image of the object "laser diode" in the optical system of the first cylindrical mirror 22*a*. Small angular deviations (typically less than 20) of the light beam in the horizontal plane do not change the position of the image point. The image of the laser diode becomes the object in the optical system of the second cylindrical mirror 22*b*. The light beam is reflected by the second cylindrical mirror 22*b* symmetrically with respect to its optical axis to a second point $I_2$ situated further aways on the flat mirror 24*a*, then to a third point $I_3$ on the flat mirror 24*a* which is the image of $I_2$ in the optical system of the third cylindrical mirror 22*c*, and finally to a fourth point $I_4$ which is the image of $I_3$ in the optical system of the fourth cylindrical mirror 22*d*, and where the light sensor 26 is positioned. Small angular deviations of the light beam in the horizontal plane do not change the position of the image points $I_1$, $I_2$, $I_3$, $I_4$. This means that a small misalignment of the laser diode 20 in the horizontal plane is compensated instead of being amplified like in the prior art.

Figure 3:
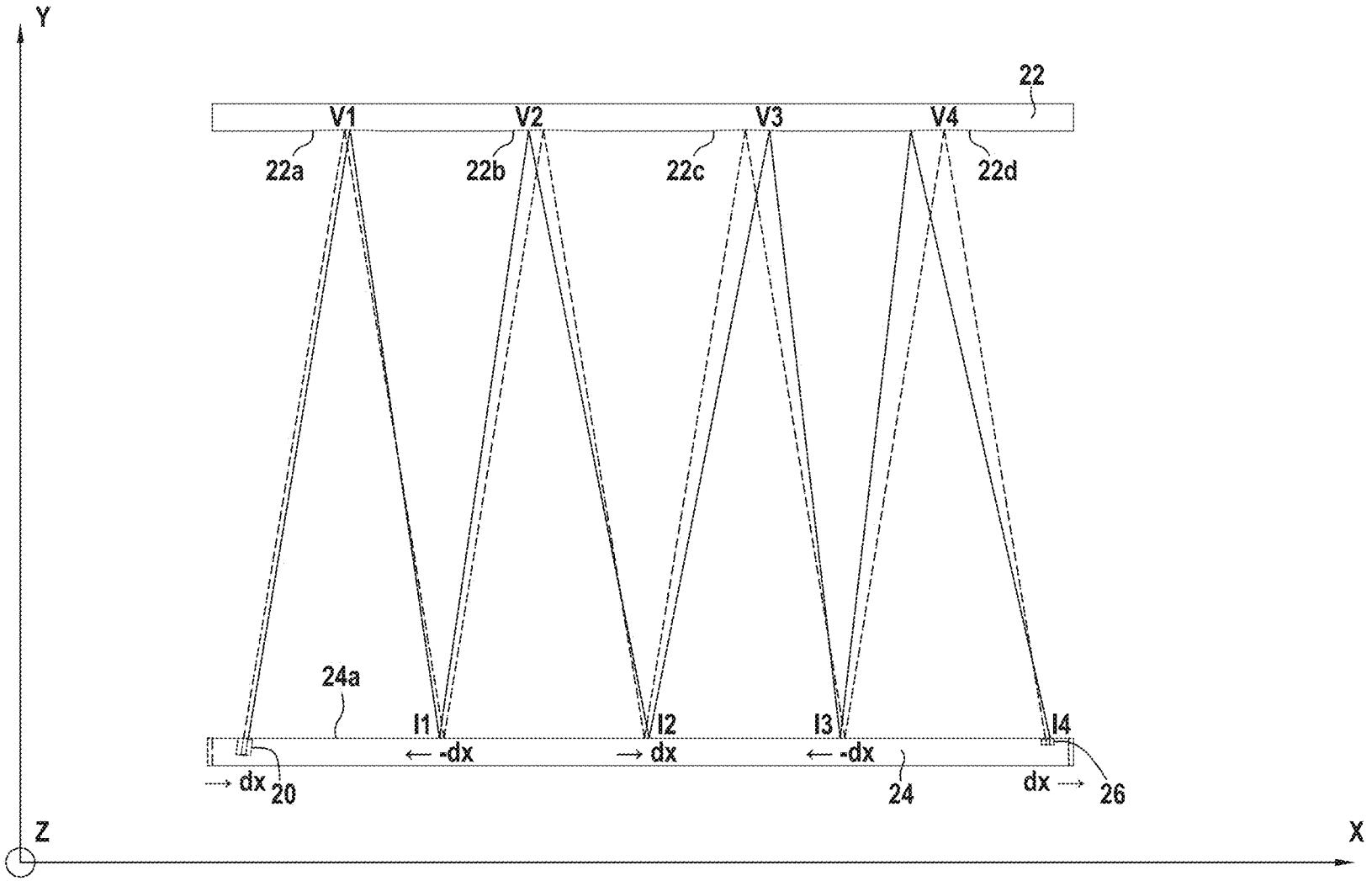
FIG. 3 shows the effect of a small lateral shift dx in the position of the laser diode.

FIG. 3 shows the effect of a small misalignment of the square rulers 22, 24 along the lateral walls of the compartment, with a small lateral shift dx in the position of the laser diode 20 (its nominal position is shown in dotted lines). The image of the laser diode is projected to the image point $I_1$ on the flat mirror 24*a*, symmetrically with respect to the optical axis of the first cylindrical mirror 22*a*, with an equal but opposite shift −dx. The image point $I_1$ is then projected by the second cylindrical mirror 22*b* symmetrically with respect to its optical axis, to a second image point $I_2$ further aways on the flat mirror 24*a*, with an equal shift dx. As there is an even number of cylindrical mirrors, the laser beam hits the region of the light sensor 26 at an image point $I_4$ with a lateral shift dx equal to the initial shift of the laser diode 20. This means that if the laser diode 20 and the light sensor 26 are precisely spaced apart on the second square ruler 24, a small misalignment between the two square rulers 22, 24 along the lateral walls of the compartment will be compensated.

Figure 4:
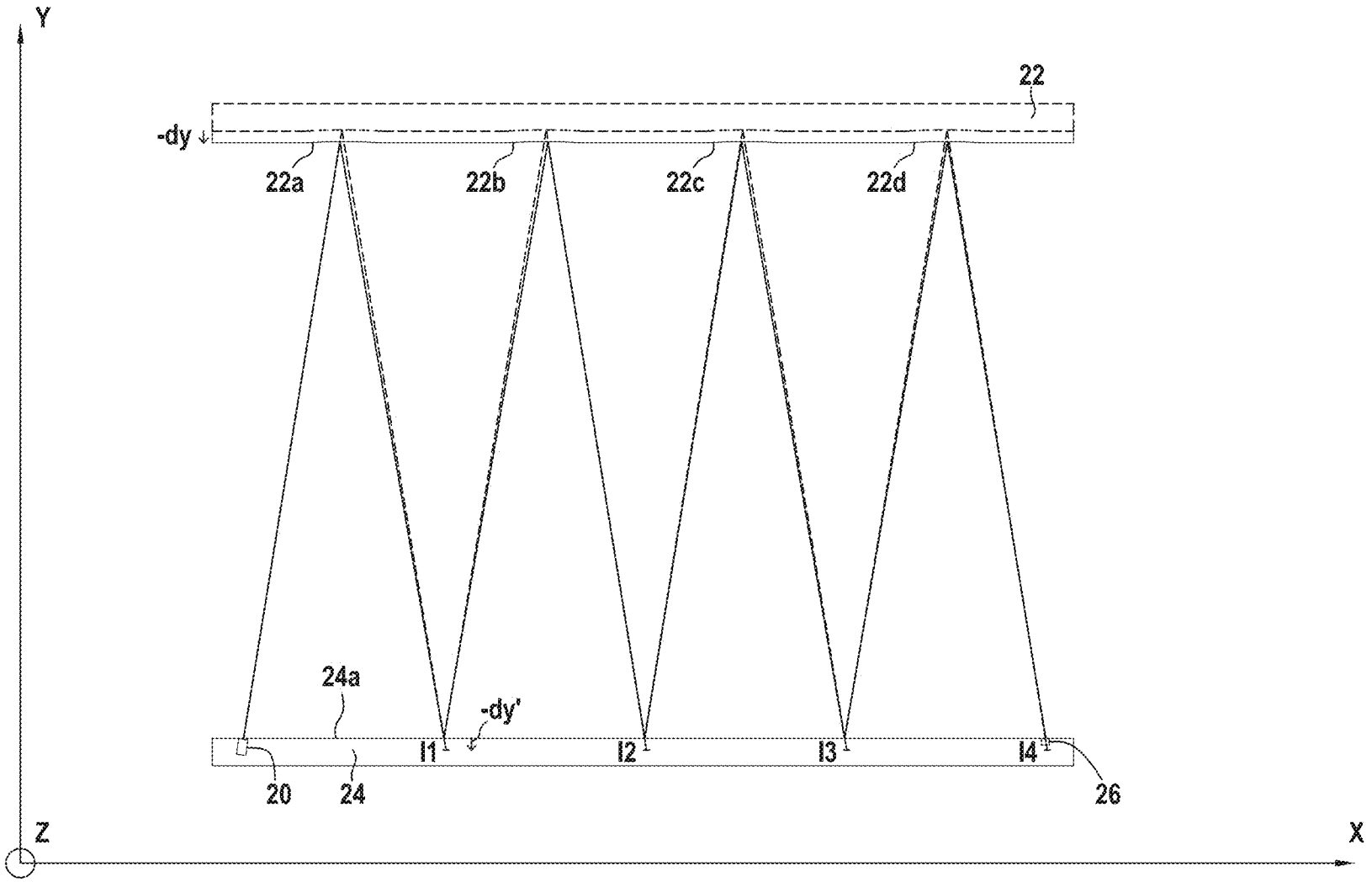
FIG. 4 shows the effect of a small transversal shift dy in the position of the laser diode.

FIG. 4 shows the effect of a small misalignment of the square rulers 22, 24 in the transverse direction, for instance if the rulers are slightly closer together than these should be, with a small transversal shift dy in the position of the laser diode 20. For convenience, the first square ruler 22 carrying the cylindrical mirrors 22*a*, 22*b*, 22*c*, 22*d* is represented with an opposite shift −dy (its nominal position is shown in dotted lines). The image of the laser diode is projected symmetrically with respect to the optical axis of the first cylindrical mirror 22*a* to a first image $I_1$ point beneath the flat mirror 24*a* with an opposite shift −dy'. The relation between dy and dy' is: $1/(R-dy)+1/(R+dy')=2/R$, which gives $dy'=dy+2dydy'/R$. As the initial shift dy is small, dy' is of the same order of magnitude and nearly equal to dy. The laser beam is reflected by the flat mirror 24*a* before reaching the image point, with a slight angular deviation and a slight lateral shift compared to the nominal situation. As seen before, the following cylindrical mirrors 22*b*, 22*c*, 22*d* tend to compensate them, and the laser beam hits the light sensor 26 with a negligible lateral shift. The light sensor 26 has an acquisition surface of typically five to ten square millimetres. The parcel detection device is thus relatively insensitive to small misalignments in the transverse direction.

Figure 5:
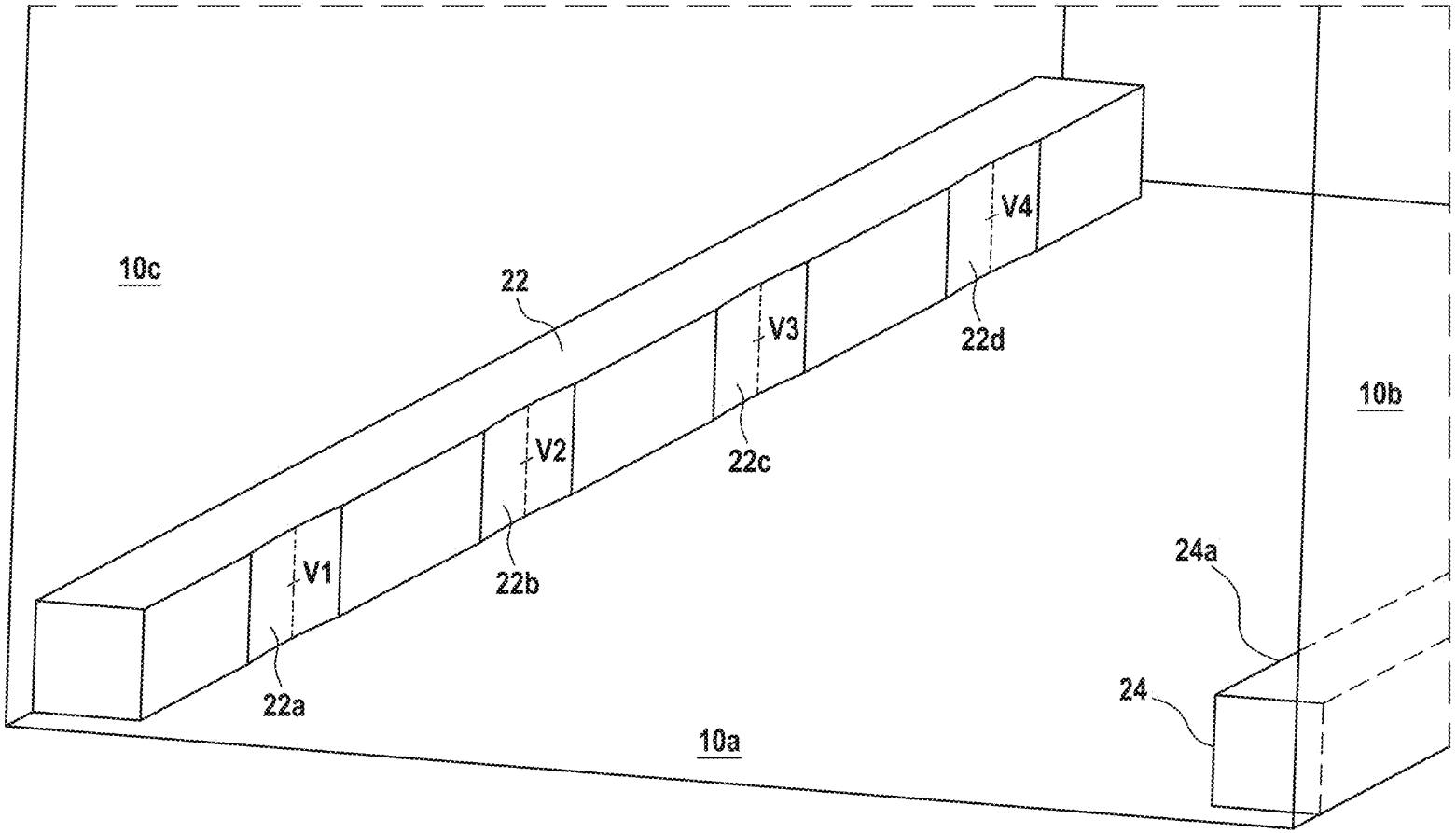
FIG. 5 is a partial perspective view of the parcel detection device of FIG. 2.

FIG. 5 is a partial perspective view of the parcel detection device of FIG. 2.

The square rulers 22, 24 are fixed to the bottom 10*a* of the compartment 10. As the cylindrical mirrors 22*a*, 22*b*, 22*c*, 22*d* have vertical axis and the flat mirror 24*a* is itself in a vertical plane, small misalignments in the vertical direction have substantially no effect, provided that the laser beam remains in a space no higher than 1 cm at the bottom of the compartment, where it can be reflected by the mirrors disposed on each side. This embodiment is satisfactory if the bottom 10*a* of the compartment is perfectly flat. However, this may not be the case because of manufacturing tolerances, warping or other distortions due to assembly constraints, travel and/or installation on an uneven ground. It is therefore quite difficult to ensure that the mirrors will be perfectly parallel.

Figure 6:
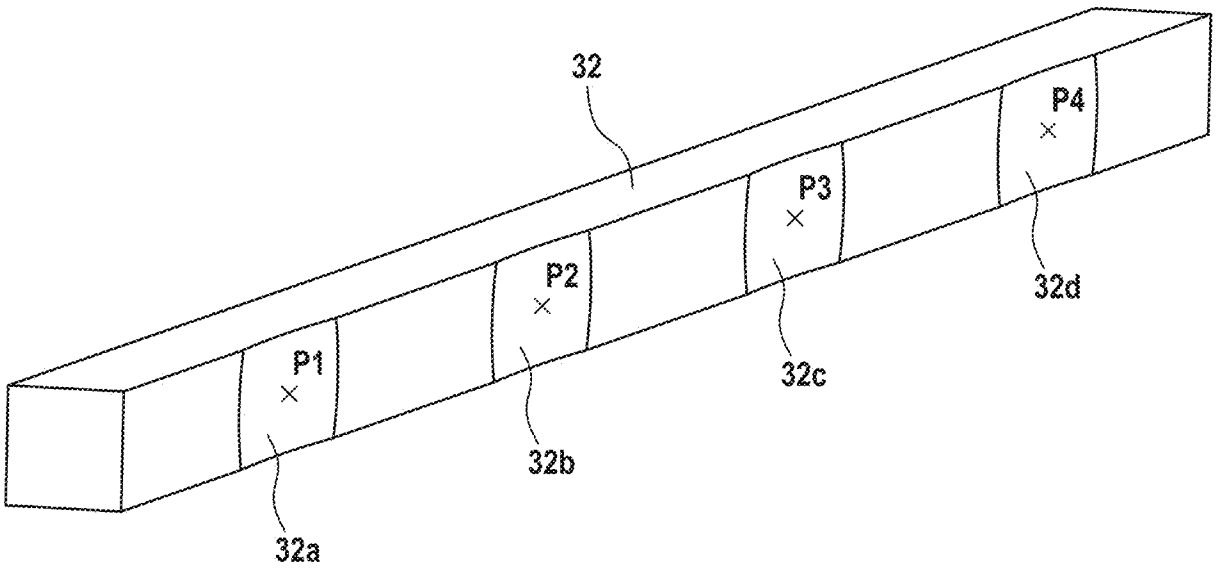
FIG. 6 is a perspective view of a square ruler in another embodiment of the parcel detection device of the invention.

A specific embodiment of the parcel detection device in which the cylindrical mirrors are replaced by spherical mirrors 32*a*, 32*b*, 32*c*, 32*d* of the same radius of curvature R is illustrated on FIG. 6. The spherical mirrors 32*a*, 32*b*, 32*c*, 32*d* can for instance be etched in a square ruler 32. The optical axes of the spherical mirrors are orthogonal to the square ruler 32 and substantially parallel to the bottom 10*a* of the compartment. The poles $P_1$, $P_2$, $P_3$, $P_4$ are positioned vertically at the level of the laser diode and the light beam is fired at an appropriate angle to hit the pole of the first spherical mirror 32*a*. The benefit of using spherical mirrors is that small angular deviations of the light beam in the vertical plane, or a small vertical shift in the position of the laser diode will be compensated in the same manner as in the horizontal plane. This specific embodiment is less sensitive to small misalignments than the one with cylindrical mirrors, but only provided that the optical axis of the spherical mirrors 32*a*, 32*b*, 32*c*, 32*d* are horizontal and that their centres $C_1$, $C_2$, $C_3$, $C_4$ are near the middle line of the flat mirror 24*a*, where the laser diode 20 and the light sensor 26 are also located. This may not be the case if the bottom of the compartment is not perfectly flat. Etching spherical portions in the corresponding square ruler 32 is also more complicated than cylindrical ones, which increases the cost of the solution.

Figure 7A:
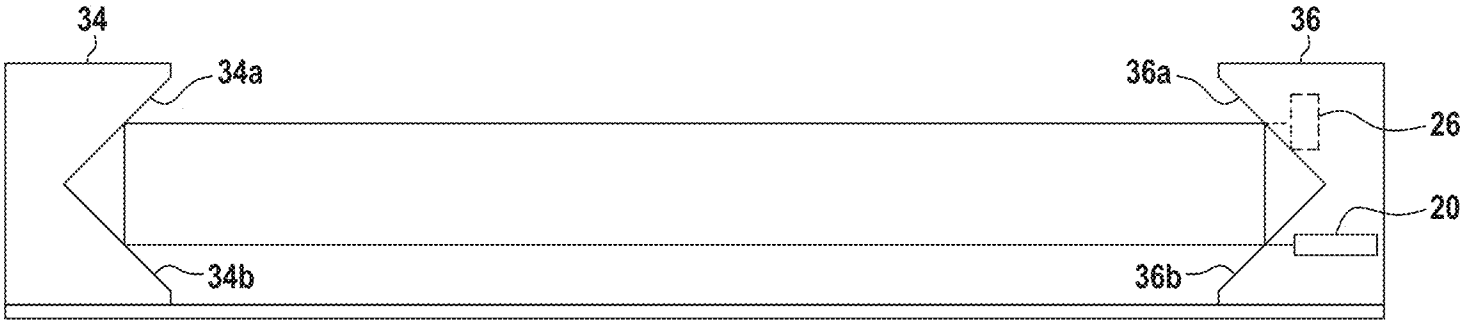
FIGS. 7A and 7B are schematic views of an alternative embodiment of the parcel detection device of the invention.
Figure 7B:
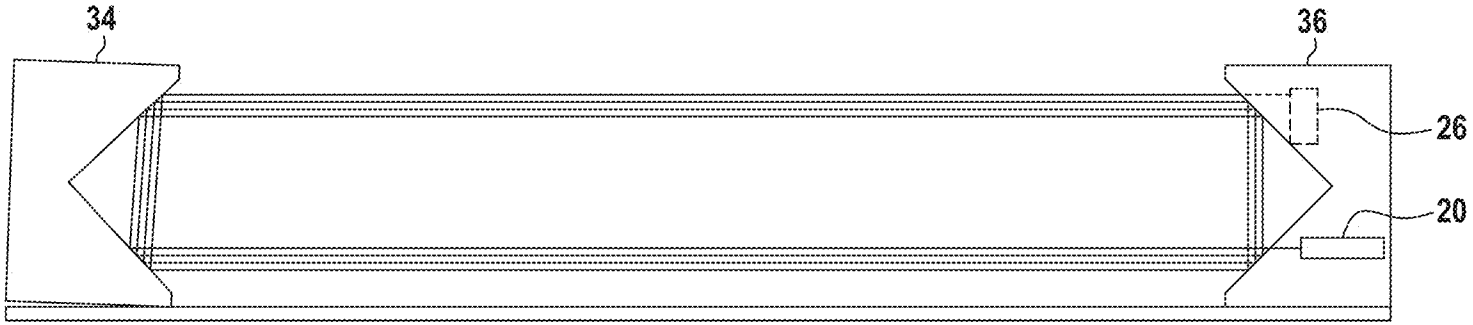

An alternative embodiment of the parcel detection device in which the mirrors are formed in two square rods 34, 36 by removing inner sections having a dihedral angle of 90° is illustrated on FIGS. 7A and 7B. For convenience, the first rod 34 and second rod 36 corresponding to the square rulers 22, 24 of the previous embodiments will be called respectively the left rod 34 and right rod 36 according to their position in the figures. The inner sections of the rods have flat sides 34*a*, 34*b*; 36*a*, 36*b* angled at +/−45° with respect to the vertical axis. Four equally spaced cylindrical sections are etched in the upper side of the inner section of the left rod 34 to form the cylindrical mirrors (see references 22*a*, 22*b*, 22*c*, 22*d* on FIG. 8). The rods are preferably made of, or coated with, a reflective material. Only portions of their inner sides may be coated. Both rods are fixed at the bottom and on opposite sides of the compartment, with their inner sections facing each other. The laser diode 20 and the light sensor 26 are mounted on opposite ends of the right rod 36, the laser diode 20 in the lower part of it (like on FIG. 1 there is only one laser diode and one light sensor). The light beam is fired at an appropriate angle (not visible on this figure) to hit the lower side of the inner section of the left rod 34, and to be reflected to the vertex of the first cylindrical mirror 22*a*.

Like in the embodiment of FIG. 2, the optical axes of the concave mirrors 22*a*, 22*b*, 22*c*, 22*d* are orthogonal to the rod 34, but the centers C1, C2, C3, C4 are no longer located near the surface of the flat mirror 36*b*. Optically the device behaves as if the mirrors 22*a*, 22*b*, 22*c*, 22*d* and 36*b* were further apart from the light travel distance in the inner sections of the rods. Because the dihedral angle of the inner section is 90°, the light coming from the laser diode 20 is reflected in substantially parallel planes and goes back and forth between the two rods 34, 36. This is still the case if one of the rods, or both, are not perfectly positioned, i.e., with a small angular twist around their longitudinal axis, as shown on FIG. 7B. (In this case the reflections are not merged on a single line like on FIG. 7A).

For convenience, the light sensor 26 is represented as mounted in the upper part of the right rod 36, although its optimal position should be in the lower part of it and facing upwards, in order to correspond to the image point $I_4$ of the laser diode, and to catch the light beam after a last reflection on the upper side 36*a* of the inner section of the right rod 36. However, as the travel distance in the inner section of the rods is of a few millimetres, mounting the light sensor 26 in the upper part is workable and also facilitates its cabling. In an alternative embodiment, the laser diode and the light sensor may be mounted in the upper part of the inner section of the right rod 36, the light sensor facing downwards in order to catch the light beam reflected by the lower side 36*b* of the inner section.

Figure 8:
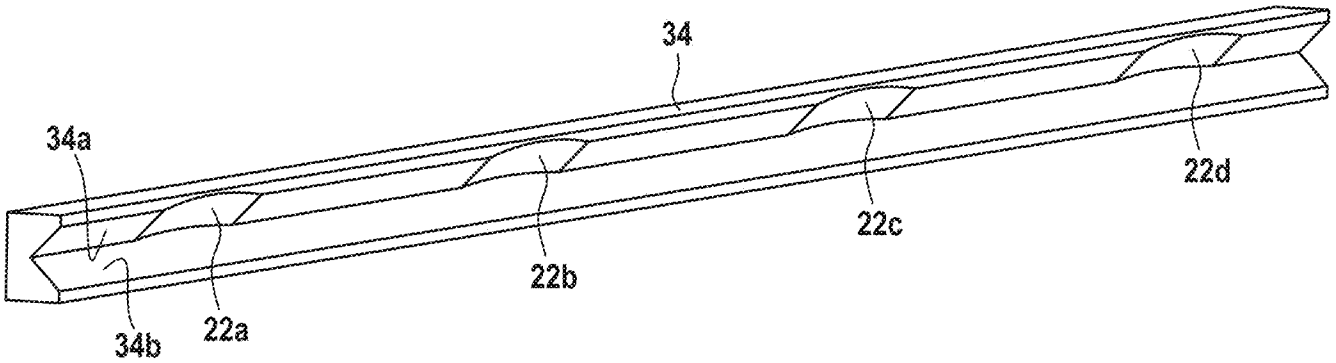
FIG. 8 is a perspective view of the square rod of the parcel detection device of FIGS. 7A and 7B.

FIG. 8 is a perspective view of the left rod 34 of the parcel detection device of FIGS. 7A and 7B.

The radius of curvature R of the cylindrical portions is adjusted by a few millimetres to encompass the additional travel distance in the inner sections of the rods. This is to ensure that the image of the laser diode is formed at the surface of the lower part of the inner section of the right rod 36, where it is reflected towards the left rod 34. In other alternative embodiments, the cylindrical mirrors could be etched in the lower side of the inner section of the left rod 34, and/or the laser diode mounted in the upper part of the right rod 36.

Figure 9:
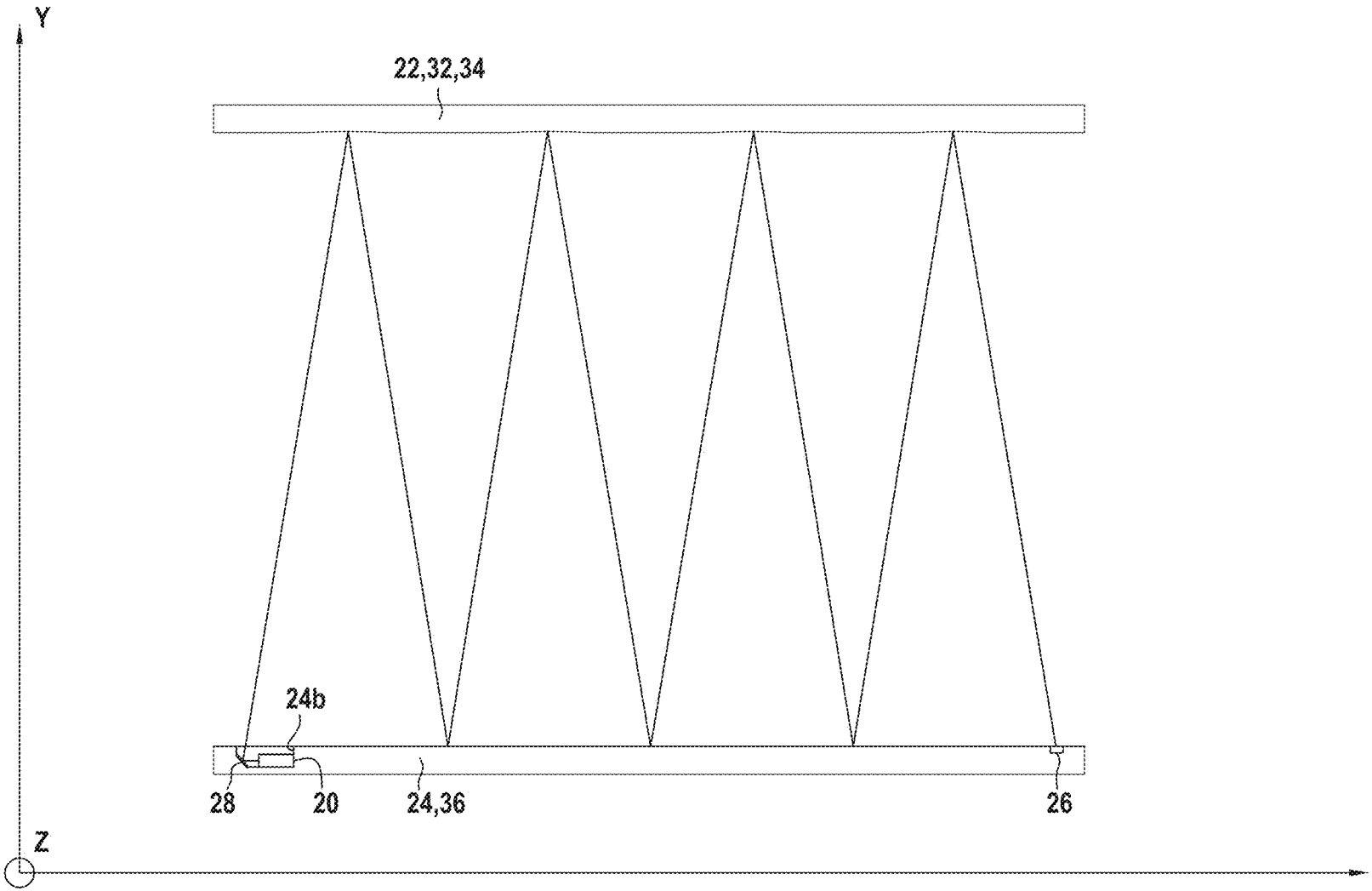
FIG. 9 is a top view of another embodiment of the parcel detection device of the invention.

FIG. 9 is a schematic top view of another embodiment of the parcel detection device of the invention.

In this particular embodiment, the laser diode 20 is not mounted in the second square ruler 24 so as to fire the light beam directly towards the first cylindrical (or spherical) mirror 22*a*, 32*a*. Indeed, the laser diode may be too long to be conveniently lodged in the second square ruler. In this case, its tip may protrude from the second square ruler and be damaged or misaligned when knocked by heavy parcels. More particularly, a recess 24*b* is carved in the second square ruler 24 to lodge the laser diode 20 along its longitudinal axis. A small flat mirror 28 is added at the end of the second square ruler to reflect the light beam towards the first concave (cylindrical or spherical) mirror 22*a*, 32*a* with the appropriate angle. The flat mirror 28 can for instance be carved as part of the recess 24*b* if the ruler 24 is made of a reflective material. The laser diode 20 may also be mounted in the right rod 36 of FIGS. 7A and 7B in a similar manner.

Although the laser diode 20 and the light sensor 26 are shown on the right side of the compartment in the figures above, these can of course be fixed on the left side of the compartment if this simplifies the cabling of the parcel locker, moreover if the compartments are grouped in pairs of adjacent columns.

Instead of machined parts as described in the preferred embodiments, the square rulers 22, 32 or the square rods 34 carrying the concave mirrors may also be made of moulded parts, or an assembly thereof. The number of spherical or cylindrical mirrors is preferably an even number and may be adapted to the dimensions of the compartment 10 and/or of the smallest item 30 to be detected. Two concave mirrors may be enough in a small compartment while eight or ten may be required in a larger one.

The terms "cylindrical" and "spherical" shall be interpreted in a broad sense. The shape of the concave mirrors may differ from a cylinder or a sphere, as long as the main radius of curvature R of their surface at points where the laser beam hits them (the vertexes or the poles respectively) is substantially equal to the orthogonal distance between the two rulers 22, 32; 24 carrying opposite mirrors 22*a*, 22*b*, 22*c*, 22*d*; 32*a*, 32*b*, 32*c*, 32*d* and 24*a*.

In the case of perfectly cylindrical or spherical mirrors, the radius of curvature R may differ from the orthogonal distance between the rulers by a few millimetres, to ensure that the image points $I_1$, $I_2$, $I_3$ are formed at the surface of the flat mirror 24*a*, and that the position of the light sensor 26 corresponds to the image point $I_4$ of the laser diode 20.

The rulers 22, 32; 24 have been described as square. However, their section may be different provided that it presents at least a right angle to ensure that the cylindrical mirrors 22*a*, 22*b*, 22*c*, 22*d* are of vertical axis, or that the optical axis of the spherical mirrors 32*a*, 32*b*, 32*c*, 32*d* are horizontal, and that the flat mirror 24*a* is in a vertical plane once the rulers are fixed at the bottom and on opposite sides of the compartment 10.

The invention claimed is:

1. A parcel detection device for detecting an item in a compartment of a parcel locker, comprising a laser diode for emitting a light beam and a light reflector for reflecting said light beam towards a light sensor for detecting said light beam, wherein said light reflector comprises two square rulers or rods carrying opposite mirrors, a first square ruler or rod carrying a plurality of concave mirrors disposed in front of a flat mirror carried by a second square ruler or rod.

2. The parcel detection device according to claim 1, wherein the plurality of concave mirrors comprises an even number of concave mirrors.

3. The parcel detection device according to claim 1, wherein the concave mirrors each has a respective optical axis and the optical axes of the concave mirrors are orthogonal to the first square ruler or rod and wherein the concave mirrors have a radius of curvature substantially equal to an orthogonal distance between the two square rulers or rods.

4. The parcel detection device according to claim 1, wherein the square rulers or rods carrying opposite mirrors are fixed at a bottom and on opposite sides of the compartment.

5. The parcel detection device according to claim 1, wherein the concave mirrors are cylindrical mirrors of vertical axis located at points distant from each other of a determined gap and disposed in front of the flat mirror, itself disposed in a vertical plane.

6. The parcel detection device according to claim 5, wherein the cylindrical mirrors are formed by equally spaced cylindrical portions etched in a first square ruler made of, or subsequently coated with, a reflective material, and the flat mirror is formed in a second square ruler made of, or coated with, a reflective material.

7. The parcel detection device according to claim 1, wherein the concave mirrors are spherical mirrors located at points distant from each other of a determined gap and disposed in front of the flat mirror, itself disposed in a vertical plane.

8. The parcel detection device according to claim 7, wherein the light beam is configured to be fired at an appropriate angle to hit a pole of a first one of the spherical mirrors.

9. The parcel detection device according to claim 5, wherein the light beam is configured to be fired at an appropriate angle to hit a vertex of a first one of the cylindrical mirrors.

10. The parcel detection device according to claim 1, wherein the second square ruler carrying the flat mirror is thick enough to lodge the laser diode and the light sensor.

11. The parcel detection device according to claim 1, wherein the plurality of concave mirrors is adapted to a set of dimensions of the compartment and/or of a smallest item to be detected in the compartment.

12. The parcel detection device according to claim 1, wherein a set of inner dimensions of the compartment are approximately 42 centimetres wide and 59 centimetres deep, and the item can be as small as 10×10×1 centimetres.

13. The parcel detection device according to claim 1, wherein the mirrors are formed in square rods by removing inner sections having a dihedral angle of 90°, the inner sections of the rods having flat sides angled at +/−45° with respect to a vertical axis, and wherein equally spaced cylindrical sections are etched in an upper side, or alternatively in a lower side, of the inner section of one of the two rods to form the cylindrical mirrors and the rods are fixed at a bottom and on opposite sides of the compartment with their inner sections facing each other.

14. The parcel detection device according to claim 1, wherein a recess is carved in the second square ruler or rod to lodge the laser diode along its longitudinal axis and a small flat mirror is added or carved at an end of the second square ruler or rod to reflect the light beam towards the first square ruler or rod.

15. Parcel detection device according to claim 1, further comprising a position sensor attached to a side of the compartment or integrated in a lock of a door of the compartment to detect the position of the door.

16. The parcel detection device according to claim 1, wherein the light beam is configured to be obfuscated when an item is placed in the compartment, and the item is detected.

* * * * *